US005315909A

United States Patent [19]

Hsu

[11] Patent Number: 5,315,909

[45] Date of Patent: May 31, 1994

[54] MUSICAL WIND CHIME

[76] Inventor: Yang-Wen Hsu, 1st Fl., No. 17, Kechiang Rd., Shihlin Dist., Taipei, Taiwan

[21] Appl. No.: 961,746

[22] Filed: Oct. 16, 1992

[51] Int. Cl.[5] ..... G10D 13/08

[52] U.S. Cl. ..... 84/404; 84/600; 116/141; 116/155; D17/22; D17/99; D10/116; D11/141

[58] Field of Search ..... 84/404, 406, 600, 601, 84/602, 95.2, 94.2, 95.1, 94.1, 103, 402, 403; 116/141, 148, 151, 155; D17/22, 99; D10/116; D11/141

[56] References Cited

U.S. PATENT DOCUMENTS

| | | | |
|---|---|---|---|
| 2,495,365 | 1/1950 | Cohn | 84/94.2 |
| 2,800,870 | 7/1957 | Garthwait | 116/155 |
| 3,910,225 | 10/1975 | Huber | 84/103 |
| 4,854,214 | 8/1989 | Lowe | 84/404 |
| 4,872,387 | 10/1989 | Melia | 84/95.2 |

*Primary Examiner*—Michael L. Gellner

*Assistant Examiner*—Cassandra C. Spyrou

*Attorney, Agent, or Firm*—Robbins, Berliner & Carson

[57] ABSTRACT

A musical wind chime especially to one which generates music according to the appearance of the wind chime includes a wind chime body and a sound control circuit. A power source is used to supply the required electrical power to the sound control circuit. A wind control switch connected between the power source and the sound control circuit for responding to any wind to intermittently connect the power source to the sound control circuit and generating music therefrom. The wind control switch includes a circular conductor formed inside the wind chime body, a conductive rod hung therein but not contact with the circular conductor, and a conductive ball attached to the conductive rod such that when some wind occurs it causes the conductive ball to swing and contact with the circular conductor. A wind plate is suspended under the conductive ball for receiving wind force thereby driving the conductive ball to contact with the circular conductor.

3 Claims, 5 Drawing Sheets

MUSICAL WIND CHIME

This invention relates to a musical wind chime particularly with a sound control circuit for generating corresponding music matching the appearance of the wind chime.

BACKGROUND OF THE INVENTION

The conventional wind chime is composed of a plurality of metal plates for contacting with each other and generating sound when blown by wind. However, the sound is merely caused by contacting, which does not constitute fancy music and makes the listener feel bored after long term use.

SUMMARY OF THE INVENTION

The present invention provides a musical wind chime which is composed of a wind chime body and a sound control circuit which has a first end electrically connected to a circular conductor attached on inner wall of the wind chime body and a second end electrically connected to a conductive ball which is suspended substantially in the axis of the inner space of the wind chime body. A wind plate is connected to the conductive ball just under the wind chime body for receiving wind force to drive the conductive ball to contact with the circular conductor, thereby facilitating the contacting between the conductive ball and the circular conductor. Whenever the first end and the second end of the sound control circuit are electrically coupled, the sound control circuit will generate music which suits the appearance of the wind chime body.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
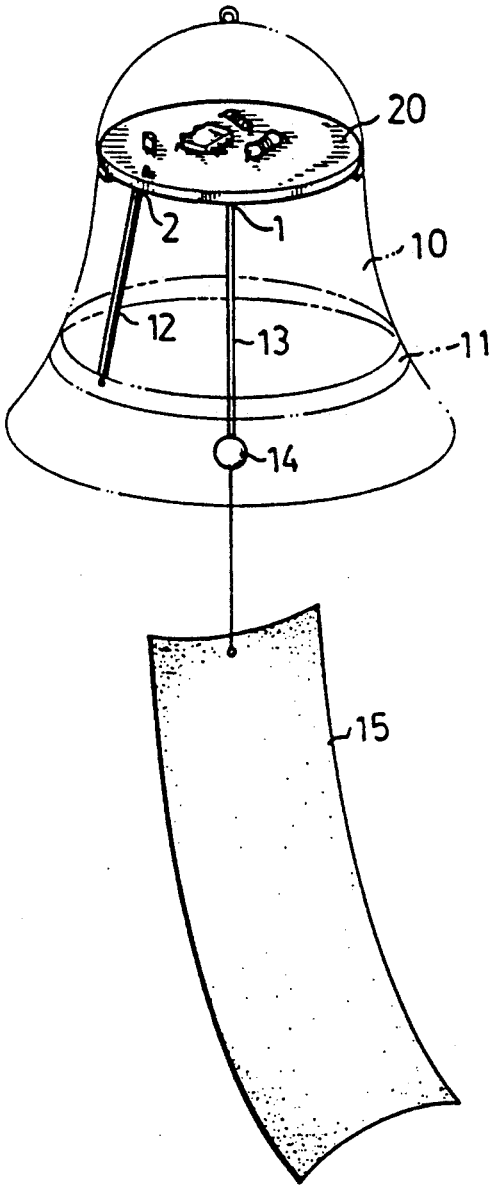
FIG. 1 is a perspective sectional view of the music wind chime of the present invention.
Figure 2:
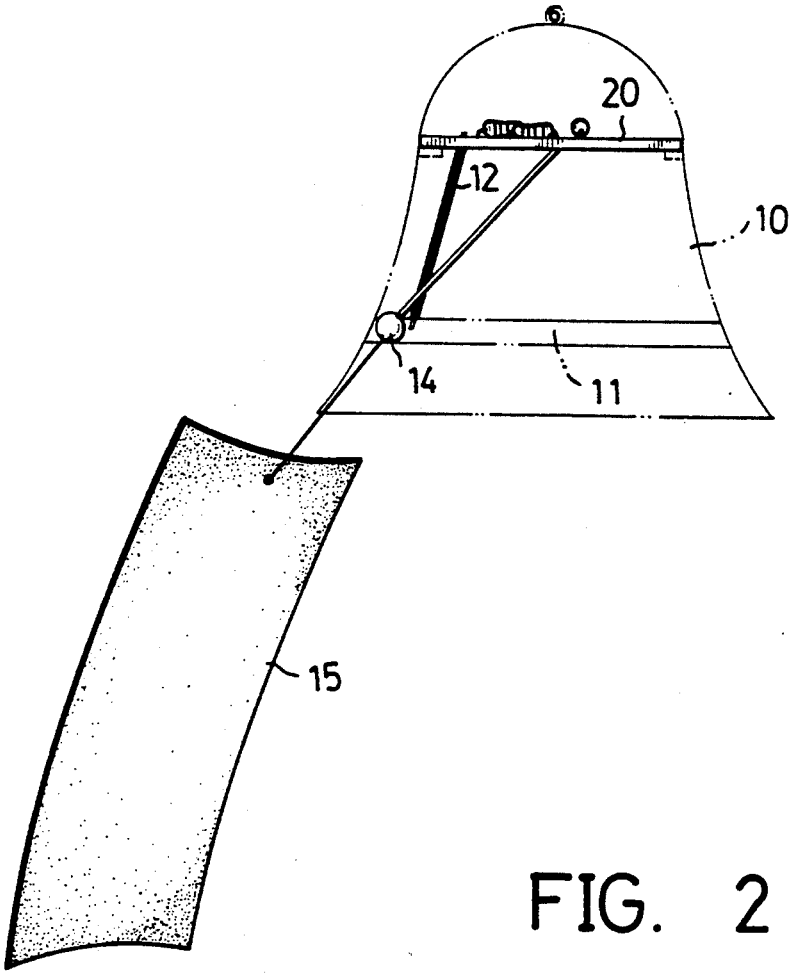
FIG. 2 is a sectional view of the present invention illustrating a conductive ball facilitated to contact with a circular conductor inside an inner wall of the wind chime.

Referring to FIG. 1, a musical wind chime comprises a wind chime body 10 and a sound control circuit 20. The wind chime body 10 is substantially a bell having an inner wall therein and defining an inner space encircled by the inner wall. A circular conductor 11 is attached in the inner wall of the wind chime body 10 and around an axis of the inner space of the wind chime body 10. The sound control circuit 20 is formed on a printed circuit board which is fixed on the inner wall of the wind chime body 10 above the circular conductor 11. A rod 13 is electrically connected to a first end 1 of the sound control circuit 20. A conductive ball 14 made of conductive material such as copper is attached to the rod 13 and suspended in the inner space of the bell 10. A wind plate 15 is further, engaged to and under the conductive ball 14 by a line (not labeled) for receiving wind and further causing the conductive ball 14 to swing in the inner space of the wind chime body 10. The length of the rod 13 is well predetermined permitting the swinging ball 14 to contact with the circular conductor 11, as shown in FIG. 2. A conductive wire 12 is electrically connected between the circular conductor 11 and a second end 2 of the sound control circuit 20. Normally the first end 1 and the second end 2 of the sound control circuit 20 are electrically isolated to each other. If the first end 1 and the second end 2 are connected to each other, the sound control circuit 20 is activated to generate predetermined music. Whenever the conductive ball contacts with the circular conductor 11, the first end 1 will be electrically connected to the second end 2 and activate the sound control circuit 20 to generate the music (see FIG. 2).

Figure 3:
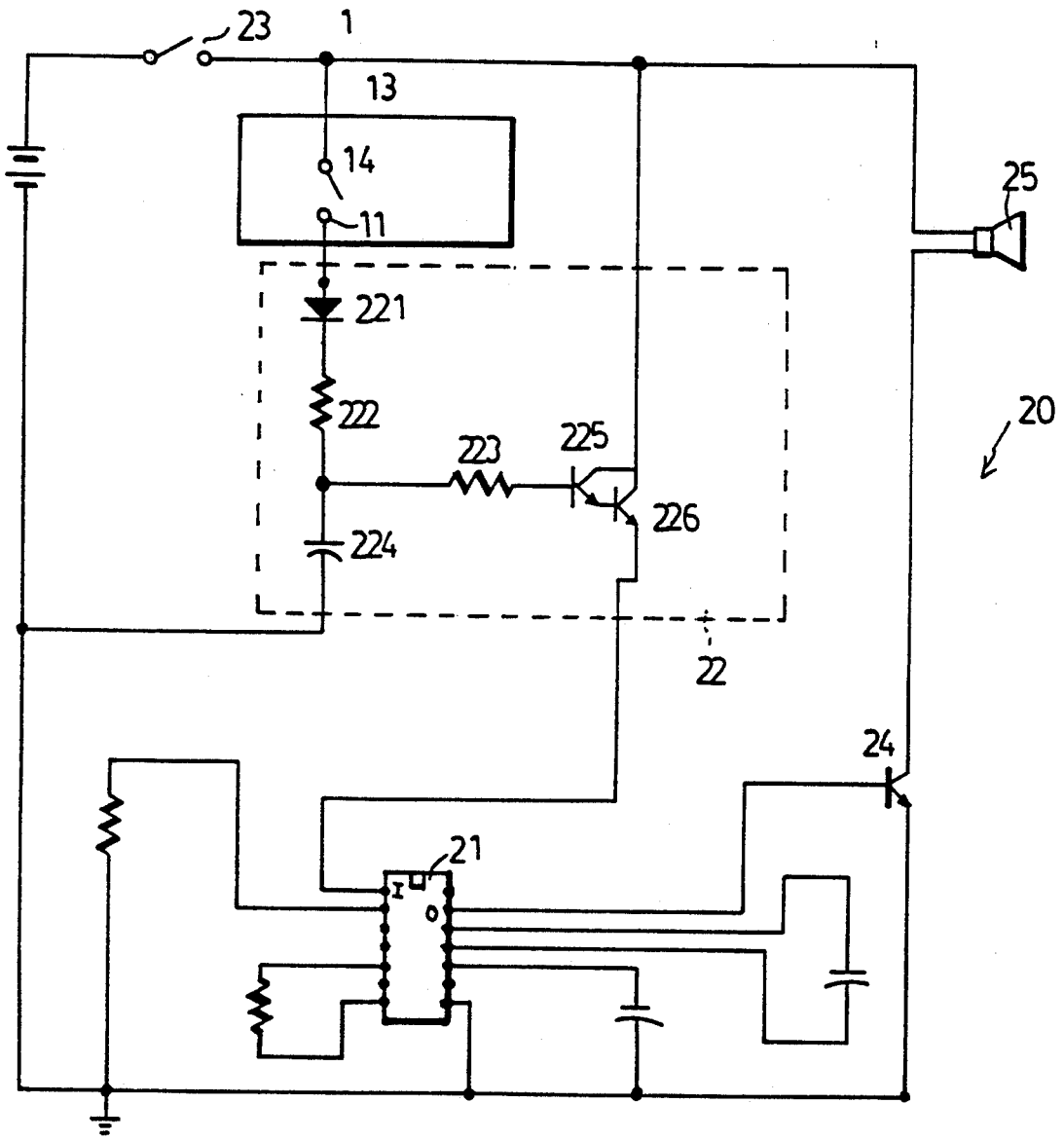
FIG. 3 is a sound control circuit used in the present invention.

Referring to FIG. 3, the sound control circuit 20 comprises a power source 30 for providing the required electrical power for the whole circuit 20, a music integrated circuit 21 for generating music therefrom, a wind switch 100 having a first end 1 electrically connected to the power source 30 and a second end 2 connected to the delay circuit 22, for responding to the wind and intermittently switching on and off, a delay circuit 22 for responding to each switching-on of the wind switch 100, generating a high level pulse, and sending the high pulse to activate the music integrated circuit 21. The wind switch 100 is composed of the conductive ball 14 and the circular conductor 11 such that when the conductive ball 14 contacts with the circular conductor 11, the wind switch 100 is in switch-on status, otherwise switch-off status. The music integrated circuit 21 is activated to output signals of music. An amplifier 24 is connected to the music integrated circuit 21 for amplifying the signals therefrom. A speaker 25 is connected to the amplifier 24 and broadcasts music whenever the music integrated circuit 21 is activated.

The delay circuit 22 comprises a diode 221, resistors 222 and 223, a capacitor 224, a second transistor 225 and a third transistor 226. The second and the third transistors 225 and 226 together constitute a Darlington transistor configuration. A manual switch 23 may be placed between the power source 30 and the first end 1 of the wind switch 100 for manual control by a user such that when the manual switch 23 is turned off, the musical wind chime is also turned off.

Figure 4:
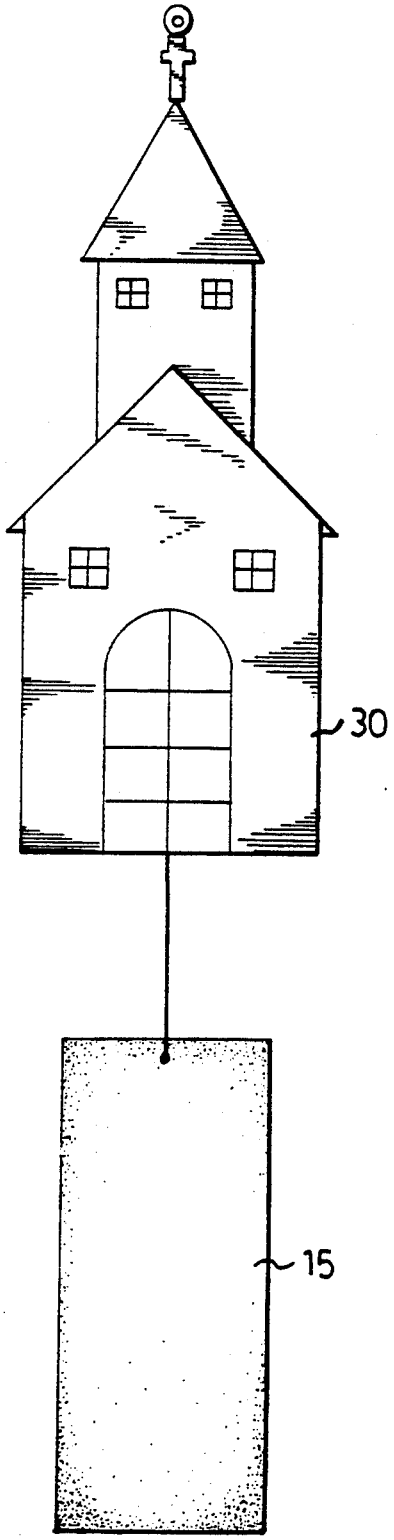
FIG. 4 is another appearance of a wind chime used in the present invention.
Figure 5:
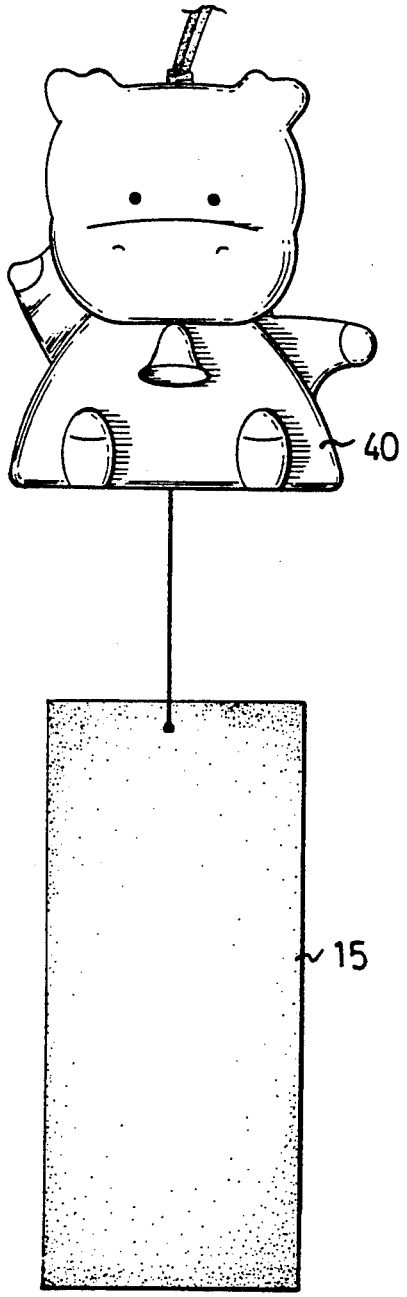
FIG. 5 is still another appearance of a chime used in the present invention.

Referring to FIG. 4, another musical wind chime has a similar construction of the one just mentioned, merely replacing the bell shaped body 10 with a new wind chime body 30 and the music may be changed to a suitable one such as a church music. The music integrated circuit 21 can be loaded with different music with respect to different appearances of wind chime bodies. FIG. 5 also illustrates another wind chime body 40 for practicing the present invention.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A musical wind chime comprising a substantially bell-like wind chime body (10) having an inner wall and defining an inner space therein, a circular conductor (11) attached in the inner wall thereof and around an axis of the inner space thereof;

a sound control circuit (20) installed in a printed circuit board which is fixed on the inner wall of the wind chime body (10) above said circular conductor (11);

a rod (13) electrically connected to said sound control circuit (20) and pivotably connected to said circuit board being suspended along the axis of the inner space of said wind chime body (10);

a conductive ball (14) being engaged at an end of said rod (13) and allowed to contact with said circular conductor (11) when blown by some wind; and a wind plate (15) being suspended under the conductive ball (14) by a line for receiving wind force thereby enabling the conductive ball (14) to contact with the circular conductor (11).

2. The music wind chime as claimed in claim 1, wherein said sound control circuit (20) comprises a power source (30) for providing electrical power to said sound control circuit (20), a music integrated circuit (21) for generating music therefrom, a wind switch (100) having a first end (1) electrically connected to the power source (30) and a second end (2) electrically connected to a delay circuit (22) for responding to the wind and intermittently switching on and off, said delay circuit (22) responding to each switching on of said wind switch (100), generating a high level pulse, and sending the high pulse to activate the music integrated circuit (21).

3. The music wind chime as claimed in claim 2, wherein said wind switch (100) is formed by said conductive ball (14) and said circular conductor (11) such that when said conductive ball (14) contacts with said circular conductor (11) said wind switch (100) is in switch-on status, otherwise in switch-off status.

* * * * *